US007293439B1

(12) United States Patent
Miao

(10) Patent No.: US 7,293,439 B1
(45) Date of Patent: Nov. 13, 2007

(54) COMBINATION PADLOCK

(75) Inventor: Tony Miao, Taipei Hsien (TW)

(73) Assignee: Jin Tay Industries Co., Ltd., Taipei Hsien (TW)

( * ) Notice: Subject to any disclaimer, the term of this patent is extended or adjusted under 35 U.S.C. 154(b) by 0 days.

(21) Appl. No.: 11/701,592

(22) Filed: Feb. 2, 2007

(51) Int. Cl.
*E05B 37/06* (2006.01)

(52) U.S. Cl. ..... 70/21; 70/25; 70/284; 70/312

(58) Field of Classification Search ..... 70/21, 70/25–28, 284, 285, 312
See application file for complete search history.

(56) References Cited

U.S. PATENT DOCUMENTS

| | | | | |
|---|---|---|---|---|
| 6,848,283 | B1 * | 2/2005 | Lin | 70/21 |
| 6,928,842 | B1 * | 8/2005 | Huang | 70/21 |
| 7,007,520 | B1 * | 3/2006 | Lin | 70/21 |
| 7,121,123 | B2 * | 10/2006 | Yu | 70/21 |
| 7,140,209 | B2 * | 11/2006 | Lai | 70/25 |
| 7,155,944 | B1 * | 1/2007 | Lin | 70/21 |
| 7,174,756 | B2 * | 2/2007 | Ling et al. | 70/284 |
| 7,210,318 | B2 * | 5/2007 | Yu | 70/21 |
| 7,210,319 | B2 * | 5/2007 | Artsiely | 70/120 |
| 7,213,425 | B2 * | 5/2007 | Ling et al. | 70/21 |
| 2004/0226323 | A1 * | 11/2004 | Ling et al. | 70/25 |
| 2005/0044901 | A1 * | 3/2005 | Yu | 70/25 |
| 2006/0027000 | A1 * | 2/2006 | Yu | 70/21 |
| 2006/0123857 | A1 * | 6/2006 | Ling et al. | 70/21 |
| 2006/0150690 | A1 * | 7/2006 | Lai et al. | 70/21 |
| 2006/0218981 | A1 * | 10/2006 | Yu | 70/21 |
| 2006/0236731 | A1 * | 10/2006 | Yu | 70/21 |
| 2006/0243005 | A1 * | 11/2006 | Lai et al. | 70/21 |
| 2006/0266084 | A1 * | 11/2006 | Kuo et al. | 70/21 |
| 2007/0125141 | A1 * | 6/2007 | Ling et al. | 70/284 |

* cited by examiner

*Primary Examiner*—Suzanne Dino Barrett
(74) *Attorney, Agent, or Firm*—William E. Pelton, Esq.; Cooper & Dunham LLP

(57) ABSTRACT

A combination padlock has a housing, a dial core, a connector, a key core and a shackle. The housing has a cavity. The dial core is mounted in the cavity and has multiple dials and a shaft extending through the dials and having a bottom end. The connector is mounted in the cavity and has a cylinder and a lateral arm. The cylinder has a through hole, an open slot and a slid pin extending through the open slot. The lateral arm abuts the bottom end of the shaft. The key core is mounted rotatably in the through hole and has a rail slot holding the slide pin. The combination padlock can be unlocked by either operating the dial core or inserting a corresponding key into the key core so using the combination padlock is convenient.

5 Claims, 6 Drawing Sheets

COMBINATION PADLOCK

BACKGROUND OF THE INVENTION

1. Field of the Invention

The present invention relates to a padlock, and more particularly to a combination padlock that may be unlocked by either a key or a combination.

2. Description of Related Art

Lock devices are usually used to lock doors or boxes. One type of lock devices is padlock.

A conventional padlock comprises a housing, a key core and a shackle. The housing has a cavity. The key core is mounted in the cavity in the housing and has a keyhole. The shackle is U-shaped, is mounted rotatably and slidably through the housing, is connected to and is driven by the key core to open and unlock the padlock or close and lock the padlock. Inserting a corresponding key into the keyhole causes the key core rotatable so that rotate the key with the key core would release the shackle and unlock the padlock.

Another conventional padlock comprises a housing, a dial core and a shackle. The housing has a cavity. The dial core is mounted in the cavity in the housing and has a shaft, multiple rotatable dials and a combination. The shaft is mounted slidably in the cavity. The rotatable dials are mounted rotatably around the shaft and each rotatable dial has an outer edge and multiple numeral attached to the outer edge. The shackle is mounted rotatably and slidably through the housing and is connected to the dial core. When aligning corrective numerals on the dials in a line to match the combination, the dial core is activated and releases the shackle so the padlock is unlocked.

However, each of the aforementioned padlocks may only be unlocked through a corresponding key or a combination. When the key is missed or the combination is forgotten, no other means can unlock the padlock.

To overcome the shortcomings, the present invention provides a combination padlock to mitigate or obviate the aforementioned problems.

SUMMARY OF THE INVENTION

The main objective of the invention is to provide a combination padlock that may be unlocked by either a key or a combination.

A combination padlock in accordance with the present invention comprises a housing, a dial core, a connector, a key core and a shackle. The housing has a cavity. The dial core is mounted in the cavity and has multiple dials and a shaft extending through the dials and having a bottom end. The connector is mounted in the cavity and has a cylinder and a lateral arm. The cylinder has a through hole, an open slot and a slid pin extending through the open slot. The lateral arm abuts the bottom end of the shaft. The key core is mounted rotatably in the through hole and has a rail slot holding the slide pin.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
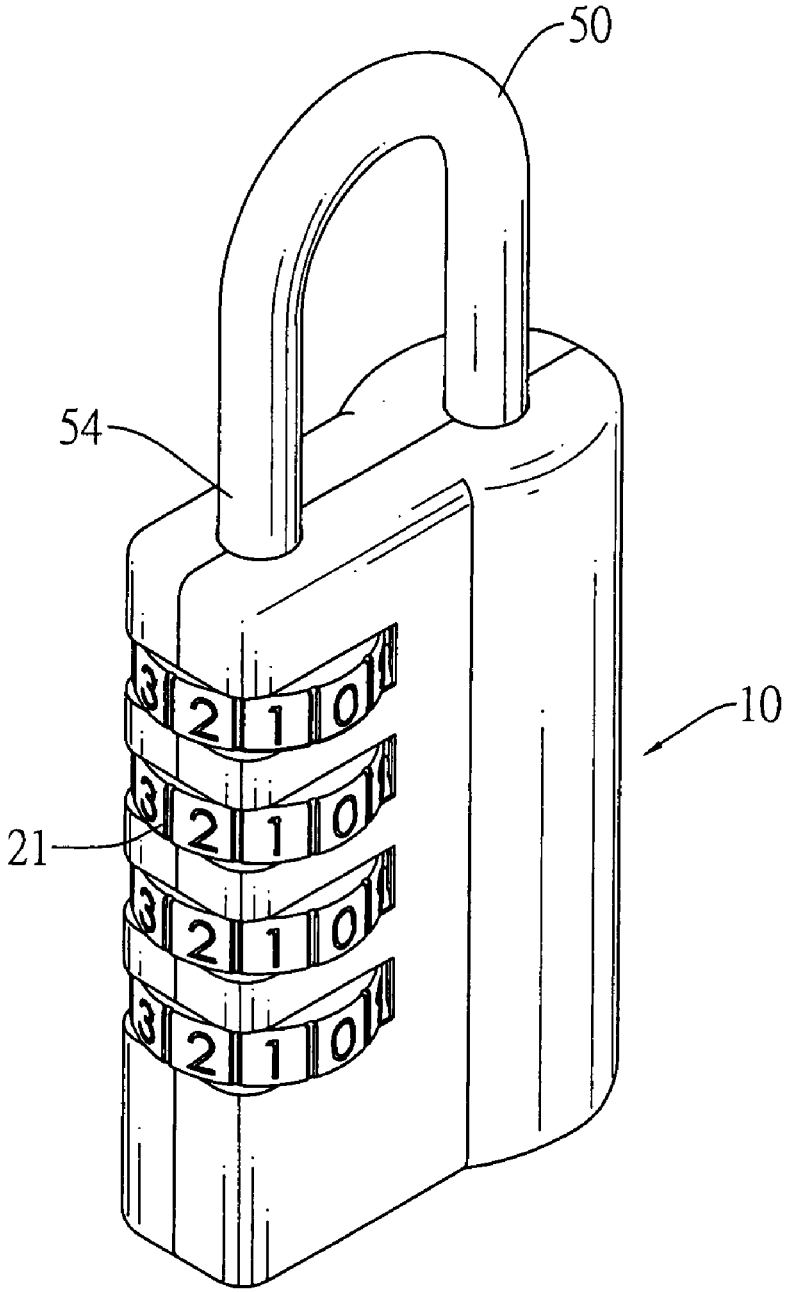
FIG. 1 is a perspective view of a combination padlock in accordance with the present invention.
Figure 2:
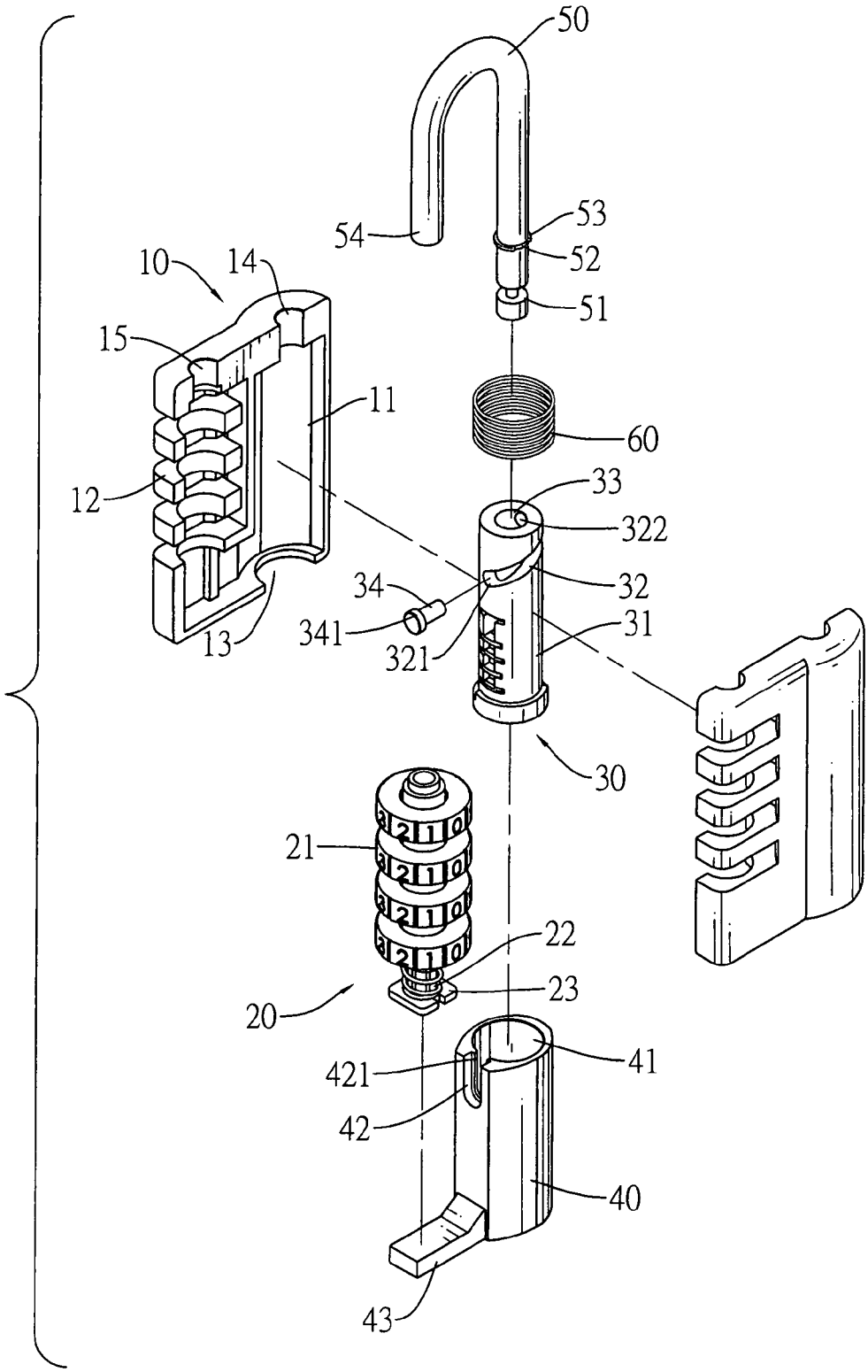
FIG. 2 is an exploded perspective view of the combination padlock in FIG. 1.

With reference to FIGS. 1 and 2, a combination padlock in accordance with the present invention comprises a housing (10), a dial core (20), a connector (40), a key core (30), a shackle (50) and a spring (60).

The housing (10) comprises two housing halves and has a top, a bottom, two sides, a cavity (11), a bottom hole (13), a top hole (14), multiple windows (12) and a locking hole (15). The cavity (11) is defined in the housing (10) and has an inner surface. The bottom hole (13) is defined in the bottom of the housing (10) and communicates with the cavity (11). The top hole (14) is defined in the top of the housing (10) and communicates with the cavity (11). The windows (12) are defined through the housing (10) adjacent to one of the sides, communicate with the cavity (11) and are arranged in a row. The locking hole (15) is defined in the top of the housing (10) and communicates with the cavity (11).

The dial core (20) is mounted in the cavity (11) and has a combination, multiple dials (21), a shaft (22), a retaining tab (23) and a spring. The dials (21) are annular, are mounted rotatably in the cavity (11), correspond respectively to and are partially exposed respectively out of the windows (12) and each dial (21) has an outer edge, a central hole and multiple numerals. The central hole is defined through the dial (21). The numerals are mounted on the outer edge. The shaft (22) is mounted in the cavity (11), is aligned with the locking hole (15), extends through the central holes in the dials (21), selectively slides upward and has a bottom end. When corrective numerals on the dials (21) are arranged in a line to match the combination, the shaft (22) is released and is capable of sliding upward. The retaining tab (23) is mounted securely on the bottom end of the shaft (22). The spring is mounted around the shaft (22) between a lowest dial (21) and the retaining tab (22) and biases the shaft (22) downward.

Figure 3:
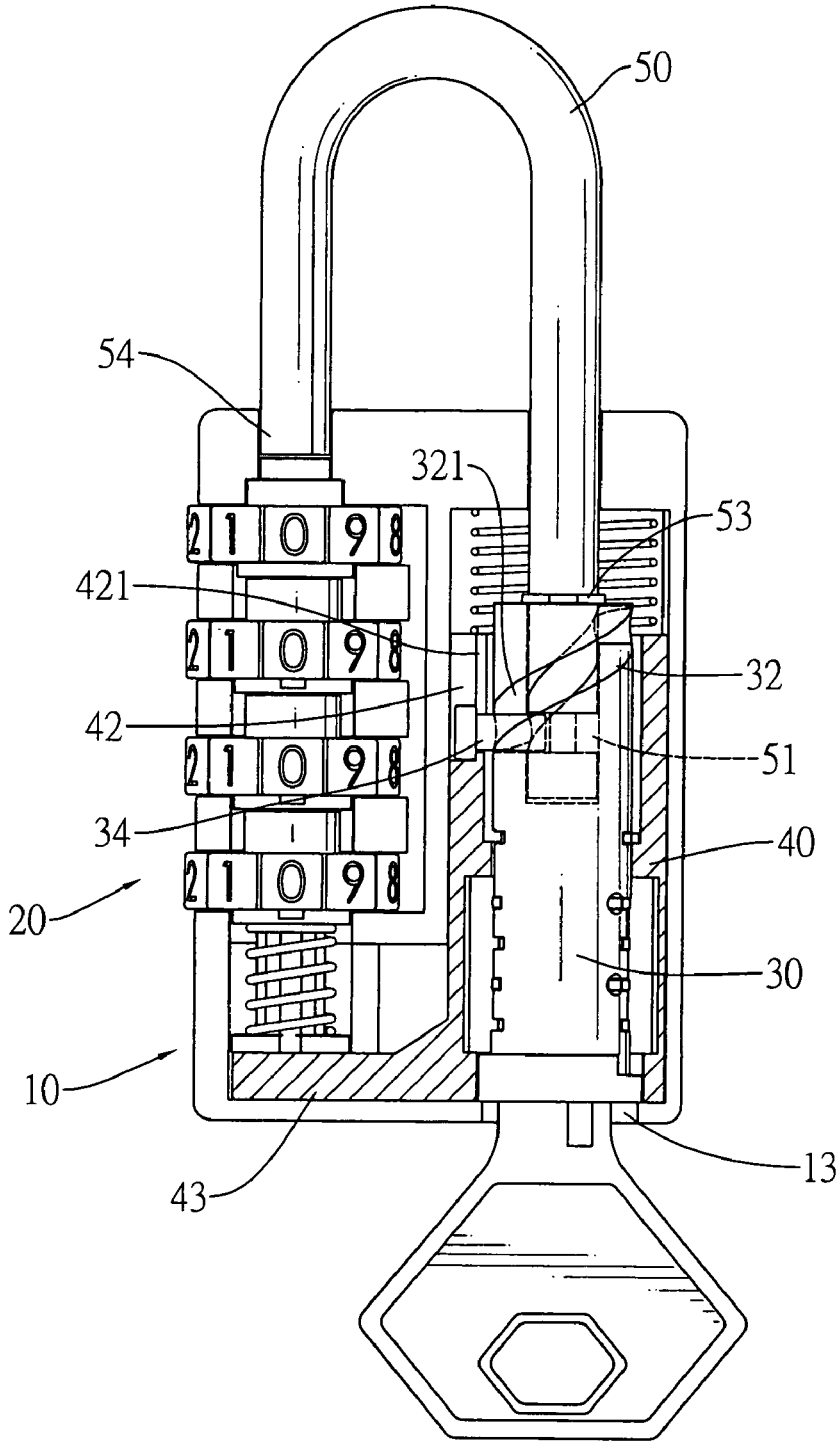
FIG. 3 is a front view in partial section of the combination padlock in FIG. 1 with the key inserted into the key core.

With further reference to FIG. 3, the connector (40) is mounted slidably in the cavity (11), selectively presses the shaft (22) to slide upward and has a cylinder and a lateral arm (43). The cylinder is mounted slidably in the cavity (11) in the housing (10) and has a top edge, a through hole (41) and an open slot (42). The through hole (41) is defined longitudinally through the cylinder and is aligned with the top hole (14) and the bottom hole (13) in the housing (10). The open slot (42) is defined longitudinally in the top edge, communicates with the through hole (41) and has an inner surface and an inner lip (421) being U-shaped and formed on and protruding inward from the inner surface. The lateral arm (43) is formed on and protrudes transversely from the cylinder and abuts the bottom end of the shaft (22).

The key core (30) is mounted rotatably and non-slidably in the through hole (41) in the cylinder (40) and has a top end, a bottom end, a keyhole, a mounting hole (33), a rail slot (32) and a slide pin (34). The keyhole is defined in the bottom end of the key core (30), is aligned with the bottom hole (13) in the housing (10) and corresponds to a key. The mounting hole (33) is defined in the top end of the key core (30) and is aligned with the top hole (14) in the housing (10). The rail slot (32) is defined spirally and radially in the key core (30), communicates with the mounting hole (33) and has a lower inside end (321) and an upper inside end (322). The slide pin (34) is mounted through the open slot (42) in the cylinder, is mounted slidably in the rail slot (32) in the key core (30) and has an inside end, an outside end and an enlarged head (341). The inside extends in the mounting hole (33) in the key core (30). The enlarged head (341) is formed on the outside end and abuts the inner lip (421).

The shackle (50) is U-shaped, is mounted in the cavity (11) in the housing (10) and has a mounting end, a locking end (54), an annular recess (51), a mounting groove (52) and a C-clip (53). The mounting end is mounted rotatably and slidably in the mounting hole (33) in the key core (30). The locking end (54) engages selectively with the locking hole (15) to lock the combination padlock. The annular recess (51) is defined radially in the shackle (50) adjacent to the mounting end and receives and holds the inside end of the slide pin (34). The mounting groove (52) is defined radially in the shackle (50) above the annular recess (51). The C-clip (53) is mounted in the mounting groove (53) and abuts the inner surface of the cavity (11) adjacent to the top hole (14) to prevent the shackle (50) from falling out of the housing (10).

The spring (60) is mounted around the shackle (50) between the top edge of the cylinder and the inner surface of the cavity (11) in the housing (10) and biases the connector (40) downward.

Figure 4:
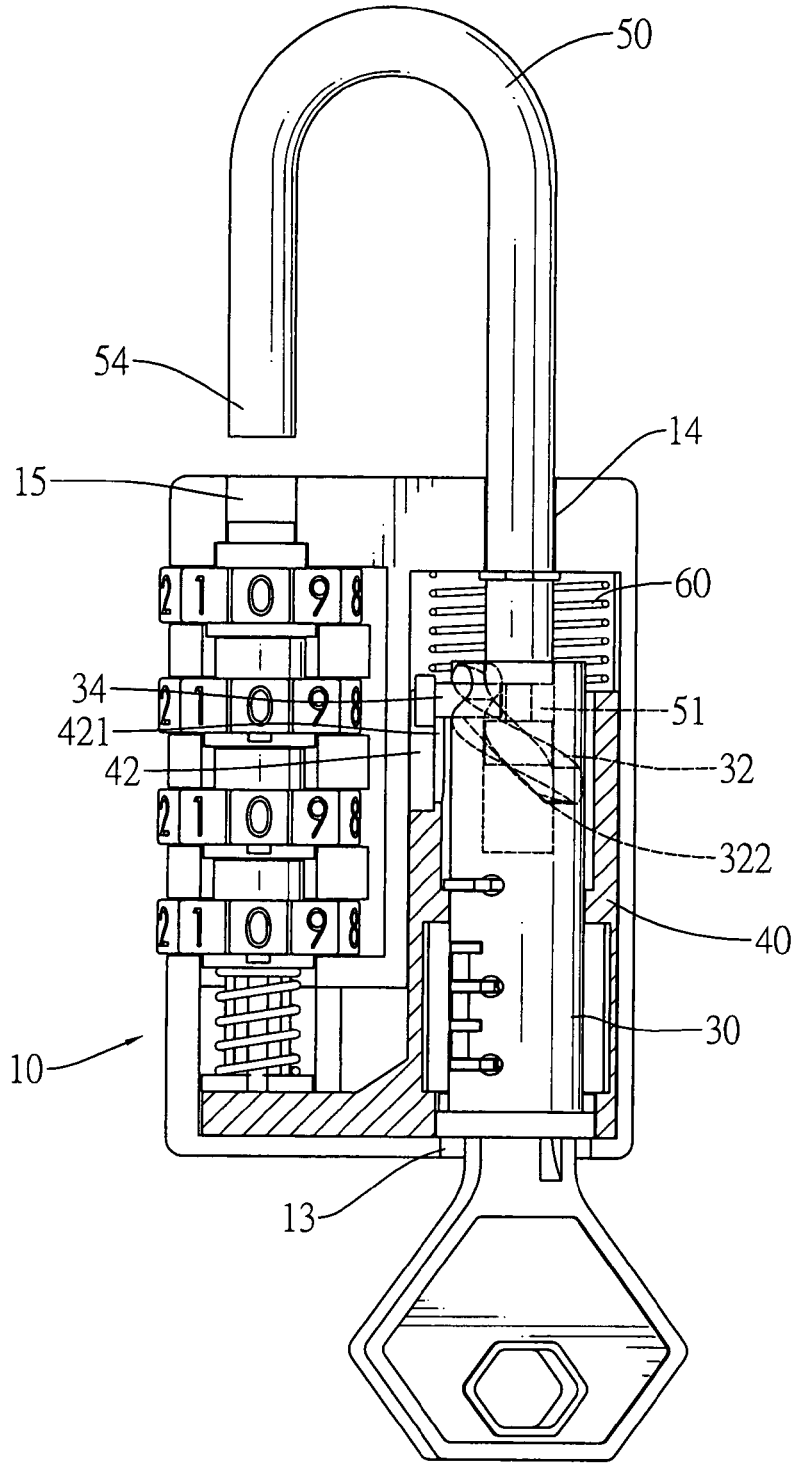
FIG. 4 is an operational front view in partial section of the combination padlock in FIG. 3 with a key in the key core rotating to open the shackle.

With reference to FIGS. 3 and 4, inserting the corresponding key into the key hole in the key core (30) through the bottom hole (13) causes the key core (30) to be rotatable. Rotating the key with the key core (30) causes the inside end of the slide pin (34) slide from the lower inside end (321) to the upper inside end (322) of the rail slot (32) in the key core (30) and drive the mounting end of the shackle (50) to move upward. The shackle (50) is therefore raised and the locking end (54) disengages from the locking hole (15) in the housing (10) to unlock the combination padlock.

Figure 5:
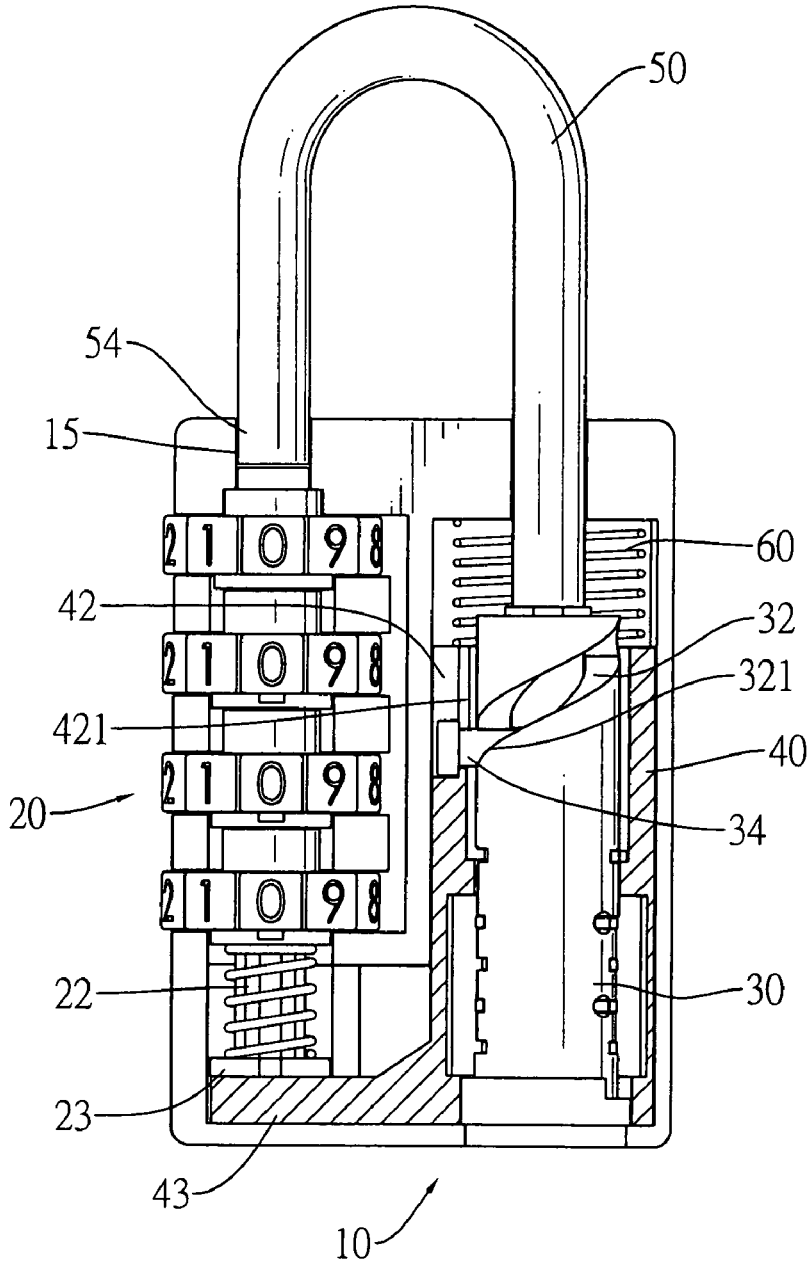
FIG. 5 is a front view in partial section of the combination padlock in FIG. 1 with the rotatable dials rotated to match the combination to open the shackle.
Figure 6:
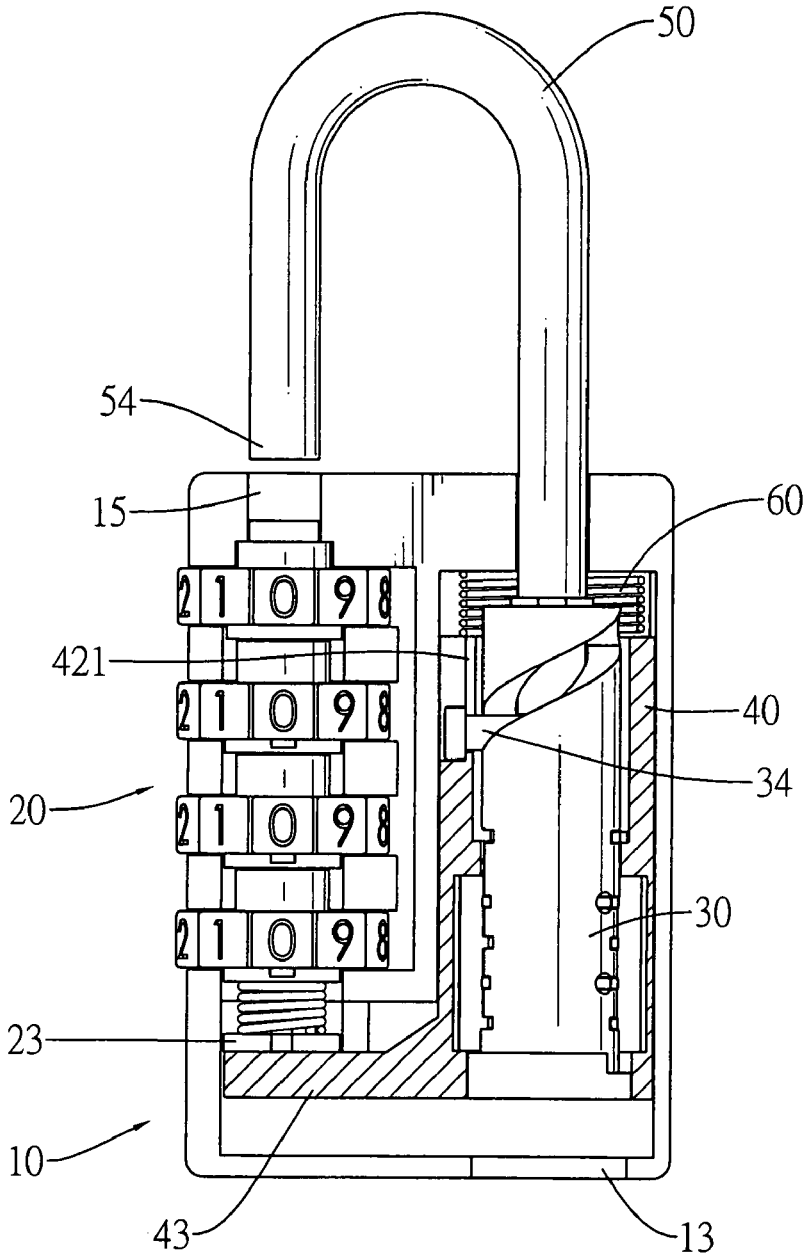
FIG. 6 is an operational front view in partial section of the combination padlock in FIG. 5 with the shackle released and pulled up.

Reference to FIGS. 5 and 6, the combination padlock is unlocked alternatively by operating the dials (21) on the dial core (20). Aligning corrective numerals on the dials (21) in a line to match the combination causes the shaft (22) to be released and be capable of sliding upward. At this time, pulling the shackle (50) moves the connector (40) upward. Because the shaft (22) is released and is slidable, the lateral arm (43) on the connector (40) would smoothly presses the shaft (22) upward instead of being blocked by the shaft (22). Therefore, the shackle (50) is smoothly pulled up and the locking end (54) disengages from the locking hole (15).

The combination padlock can be unlocked by either operating the dial core (20) to match the combination or inserting a corresponding key into the key core (30). Accordingly, people missing the key may still unlock the combination padlock with the combination, and vice versa. Therefore, using combination padlock is convenient.

Even though numerous characteristics and advantages of the present invention have been set forth in the foregoing description, together with detail of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A combination padlock comprising:

a housing having a top;

a bottom;

a cavity defined in the housing and having an inner surface;

a bottom hole defined in the bottom and communicating with the cavity;

a top hole defined in the top and communicating with the cavity;

multiple windows defined through the housing, communicating with the cavity and arranged in a row; and a locking hole defined in the top and communicating with the cavity;

a dial core mounted in the cavity and having multiple dials being annular, mounted rotatably in the cavity, corresponding respectively to and partially exposed respectively out of the windows and each dial having an outer edge, a central hole defined through the dial and multiple numerals mounted on the outer edge; and a shaft mounted in the cavity, aligned with the locking hole, extending through the central holes in the dials, selectively sliding upward and having a bottom end;

a connector mounted slidably in the cavity, selectively pressing the shaft to slide upward and having a cylinder mounted slidably in the cavity and having a top edge, a through hole defined longitudinally through the cylinder and aligned with the top hole and the bottom hole in the housing and an open slot defined longitudinally in the top edge and communicating with the through hole; and a lateral arm formed on and protruding transversely from the cylinder and abutting the bottom end of the shaft;

a key core mounted rotatably in the through hole in the cylinder and having a top end;

a bottom end;

a mounting hole defined in the top end and aligned with the top hole in the housing;

a rail slot defined spirally and radially in the key core, communicating with the mounting hole and having a lower inside end and an upper inside end; and a slide pin mounted through the open slot in the cylinder, mounted slidably in the rail slot in the key core and having an outside end and an inside end; and a shackle being U-shaped, mounted in the cavity in the housing and having a mounting end mounted rotatably and slidably in the mounting hole in the key core;

a locking end engaging selectively with the locking hole; and an annular recess defined radially in the shackle adjacent to the mounting end and receiving and holding the inside end of the slide pin.

2. The combination padlock as claimed in claim 1 further comprising a spring mounted around the shackle between the top edge of the cylinder and the inner surface of the cavity in the housing and biasing the connector downward.

3. The combination padlock as claimed in claim 2, wherein:

the open slot in the cylinder of the connector has an inner surface and an inner lip being U-shaped and formed on and protruding inward from the inner surface; and the slide pin further has an enlarged head formed on the outside end and abutting the inner lip.

4. The combination padlock as claimed in claim 3, wherein the shackle further has a mounting groove defined radially in the shackle above the annular recess and a C-clip mounted in the mounting groove and abutting the inner surface of the cavity adjacent to the top hole.

5. The combination padlock as claimed in claim 4, wherein the dial core further has a retaining tab mounted securely on the bottom end of the shaft and a spring mounted around the shaft between a lowest dial and the retaining tab and biasing the shaft downward.

* * * * *